US005386770A

United States Patent [19]

De Boer

[11] Patent Number: 5,386,770

[45] Date of Patent: Feb. 7, 1995

[54] INSTALLATION FOR COMPACTING WASTE AND WASTE ASSEMBLY

[76] Inventor: Steven B. De Boer, Akkerweg 26; P.O. Box 1068., 1270 BB Huizen, Netherlands

[21] Appl. No.: 140,160

[22] PCT Filed: May 17, 1991

[86] PCT No.: PCT/NL91/00082

§ 371 Date: Nov. 5, 1993

§ 102(e) Date: Nov. 5, 1993

[87] PCT Pub. No.: WO92/20516

PCT Pub. Date: Nov. 26, 1992

[51] Int. Cl.[6] ..... B30B 5/00

[52] U.S. Cl. ..... 100/177; 100/229 A; 220/908; 414/525.55

[58] Field of Search ..... 100/156, 177, 178, 229 A, 100/233; 220/908; 414/525.55

[56] References Cited

U.S. PATENT DOCUMENTS

| | | | |
|---|---|---|---|
| 1,333,051 | 3/1920 | Young | 220/908 X |
| 3,076,250 | 2/1963 | Baer | 100/156 X |
| 3,593,656 | 7/1971 | Churchman et al. | 100/177 |
| 3,889,588 | 6/1975 | Wollersheim | 100/177 |
| 4,102,109 | 7/1978 | Modra et al. | 100/177 X |
| 4,271,756 | 6/1981 | Bettencourt | 100/229 A X |

FOREIGN PATENT DOCUMENTS

| | | | |
|---|---|---|---|
| 0341353 | 11/1989 | European Pat. Off. | 220/908 |
| 823980 | 12/1951 | Germany . | |
| 2312698 | 9/1978 | Germany . | |

*Primary Examiner*—Stephen F. Gerrity
*Attorney, Agent, or Firm*—Young & Thompson

[57] ABSTRACT

Installation for compacting waste. This installation consists of a partition pump fitted in a chamber, the changing volume being determined by the partitions and the wall of the chamber. A closable inlet is fitted, while the wall of the chamber can be designed as a hinged wall in the vicinity of the outlet. Scrapers can be provided to ensure that all of the waste remains in the outlet. The outlet can open into a conventional waste container.

9 Claims, 4 Drawing Sheets

INSTALLATION FOR COMPACTING WASTE AND WASTE ASSEMBLY

BACKGROUND OF THE INVENTION

The invention relates to an installation for compacting waste comprising a rotary element which is fitted in a chamber having an inlet and an outlet. The rotary element can move along a wall of the chamber in order to define a space which decreases in the direction of movement of the element. Such an installation is known from the German Offenlegungsschrift 2,312,698. Articles to be compacted are introduced through an entry hopper in the space which is defined by the wall and the rotating drum. The rotating drum includes partition which grasp the articles to be compacted and transport them whilst compacting to the outlet of the installation.

It has been observed that the path over which the waste is compacted is relatively short and that the material is not sufficiently compacted.

SUMMARY OF THE INVENTION

The invention aims to avoid this disadvantage by increasing the path over which the waste compacted.

This aim is achieved with an installation having an inlet which is closable in such a way that it forms part of the wall. By having the inlet closable the path over which the waste is compacted is increased and material is prevented from being pressed back towards the inlet during the first part of travel over the compacting path.

According to an advantageous embodiment of the invention, the part of the wall in the direction of rotation of the element upstream of the outlet is fitted so that it is movable against a pretensioning force. This signifies that if no further compacting can take place in the space limited by the wall of the chamber and the partitions without overloading of the system, the relevant section of the wall moves away because no further compacting takes place. A design of this type is important in particular if waste of highly variable composition is introduced.

In order to prevent material adhering to the drum of the partition pump, scrapers are preferably present downstream of the outlet for the part of the wall in the direction of rotation.

According to a further advantageous embodiment, the chamber in which the partition pump ks fitted is cylindrical and the center of rotation of the partitions is in the center of the cylinder.

In order to prevent contamination of the interior of the partition drum, sealing means, which engage on the partitions, are fitted thereon.

The partition drum described above can be driven in various ways. Both a motor and a manual drive are conceivable. In the case of a motor drive, At ks possible always to stop the partition pump in a position such that the partitions are in the optimum position in front of the inlet and outlet. This is also possible in the case of a manually operated partition pump. This can be achieved by fitting an element which is graspable only in a specific number of positions and which can be grasped by means of a handle which can move over a limited stroke.

The invention also relates to a waste assembly, comprising an installation as described above, located on a waste container. In this way, a particularly compact structure is obtained, it being possible to make use of conventional waste containers, so that the costs of the assembly can be kept defined. Easy emptying is also ensured by this means.

BRIEF DESCRIPTION OF THE DRAWINGS

The invention will be illustrated in more detail below with reference to the embodiments shown in the drawings, wherein.

DETAILED DESCRIPTION OF THE INVENTION

Figure 1:
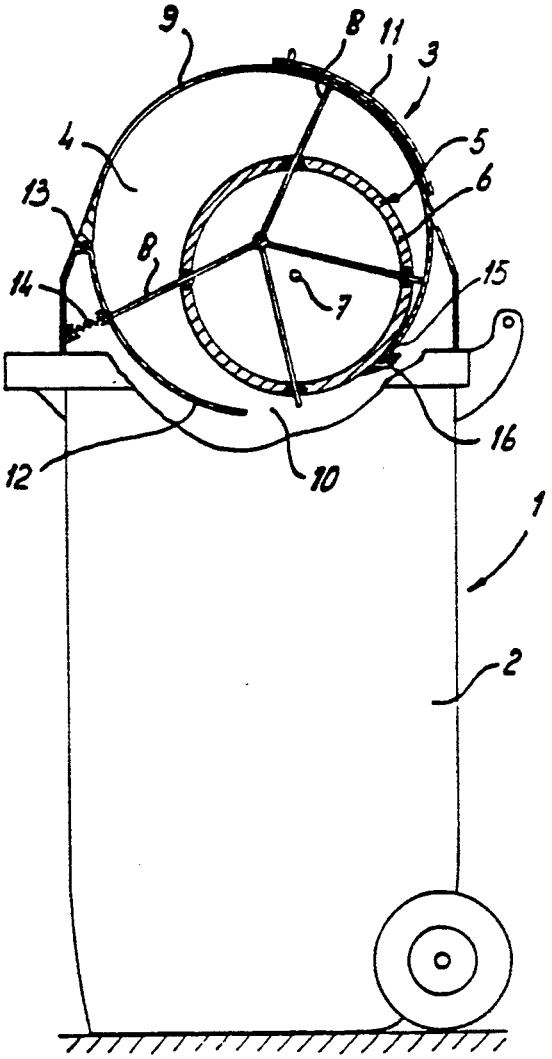
FIG. 1 shows a side view of the waste assembly according to the invention.
Figure 2:
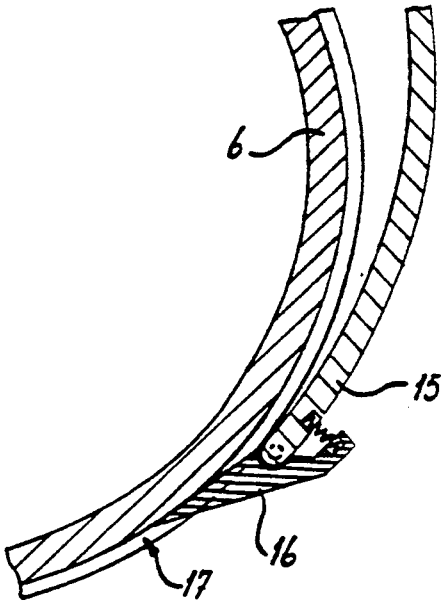
FIG. 2 shows a detail of the installation according to FIG. 1.
Figure 5:
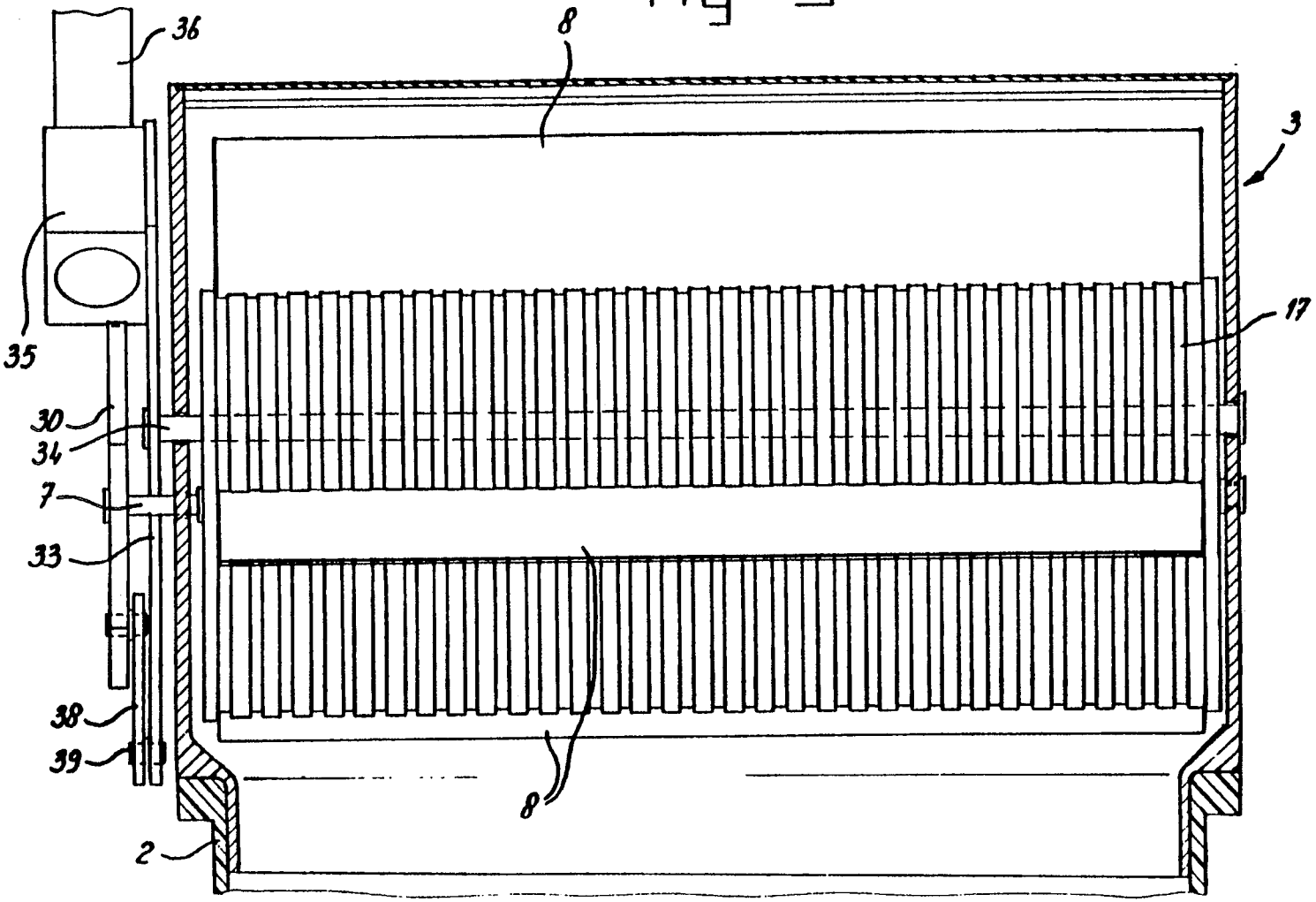
FIG. 5 shows the cross-section V—V from FIG. 3.

In FIG. 1 the waste assembly according to the invention is generally indicated by 1. This waste assembly consists of a conventional waste container 2. Here this is designated as the lower part of a container with wheels, that is to say without lid. The installation according to the invention, which is indicated by 3, As fitted An place of the lid. This installation consists of a cylindrical chamber 4 in which a partition pump 5 As located. Partition pump 5 consists of a drum 6 which has an axis of rotation 7 and partitions 8. An inlet opening 9 and an outlet opening 10 are made in chamber 4. Inlet opening 9 is closable by lid 11, which, in a space-saving manner, is movable parallel to the wall of the chamber 4. This lid can, of course, also be fitted as a hinged lid, but it As essential that after closing inlet opening 9 a continuous wall section is produced along which partitions 8 can move. The part of the wall of the chamber indicated by 12 lying in the direction of rotation of the partition pump upstream of the outlet 10 is spring-hinged. The hinge is fitted at 13 and the spring is indicated by 14. It can be seen from the detail in FIG. 2, that part 15 of the wall of chamber 4 in the direction of rotation of the partition drum downstream of outlet 10 is provided with spring-mounted scrapers 16. The shape of the scrapers corresponds to the grooved shape of the drum, which is generally indicated by 17 and, moreover, can be seen from FIG. 5.

Figure 3:
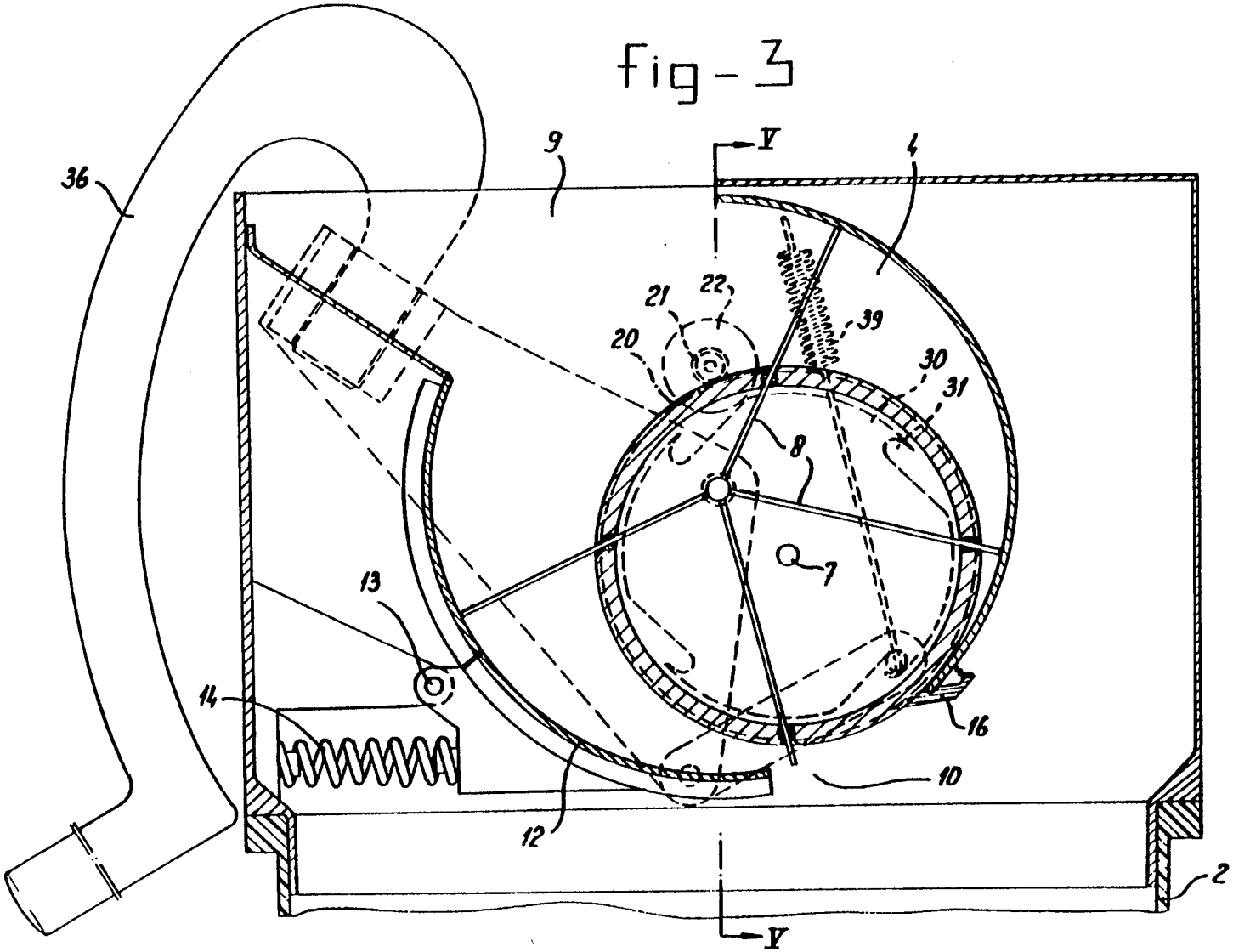
FIG. 3 shows the operating mechanism for the partition pump in two embodiments according to the invention.
Figure 4:
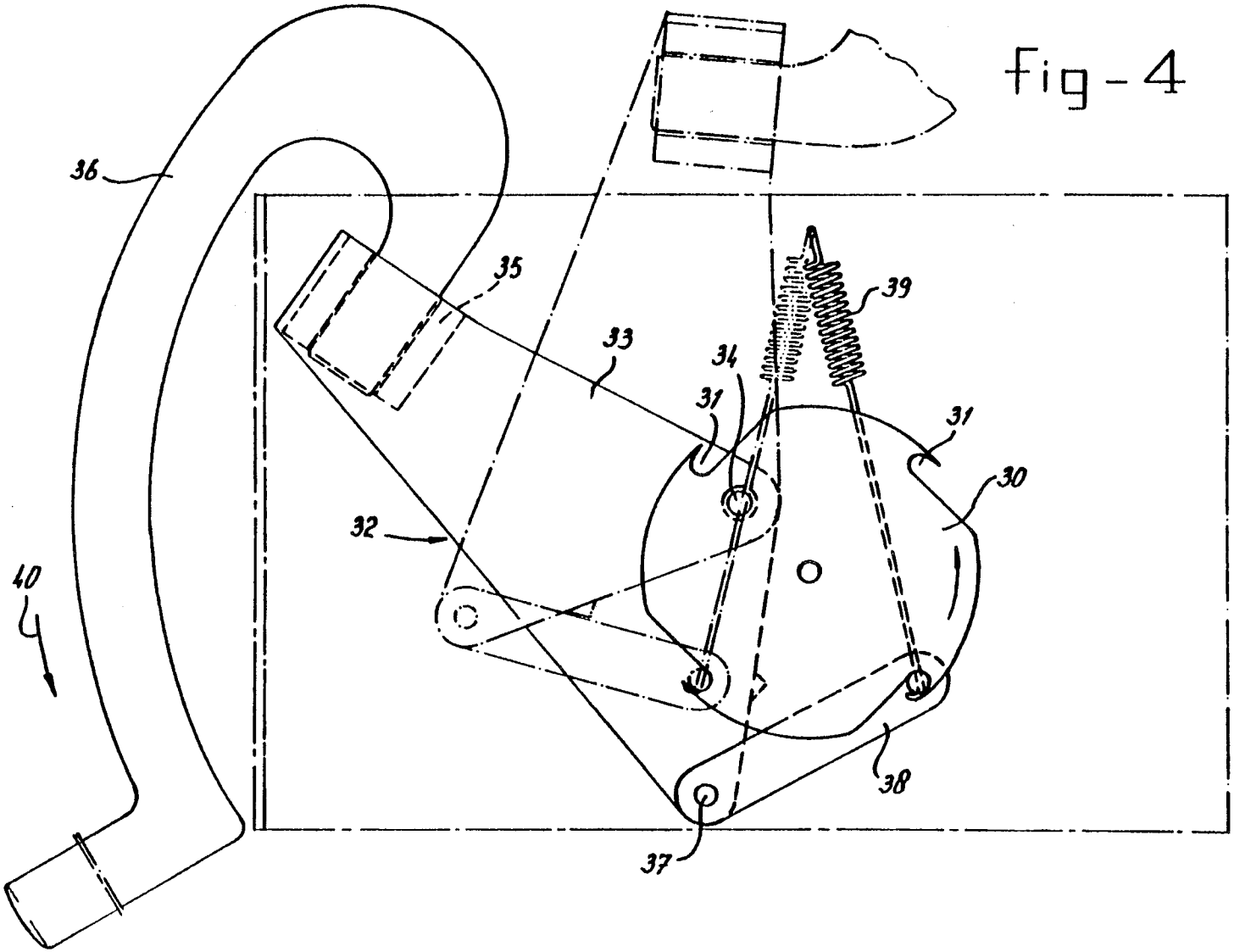
FIG. 4 shows a detail of an embodiment of an operating mechanism according to FIG. 3.

Two embodiments of the operating mechanism of the partition drum are shown in FIG. 3. Firstly, it is possible to fit on the outside of the chamber a set of teeth, indicated by 20, on which s pinion 21 of drive motor 22 can engage. Position-detecting means, which are not shown, can be present to ensure that after a compacting operation the partition pump is in the position shown in FIG. 1, so that the inlet opening 9 can be left free to the maximum extent and an optimum compacting effect can be obtained. Likewise, a safety device can be present which prevents the motor from turning if lid 11 is not completely closed. Another embodiment of the drive mechanism for the partition pump is also shown in FIGS. 3 and 4. This is a manual operation. On the outside of chamber 4, a disc 30 with recesses 31 is fitted on the shaft 7 of the drum. Four such recesses are present. As can be seen in particular from FIG. 4, a lever mechanism 32 engages in these recesses 31. Lever mechanism 32 consists of a lever arm 33, which is hinged about hinge point 34. Lever arm 33 is, on the one hand, provided with a receiver 35 for an operating lever 36. On the other hand, it is provided with a hinge point 37 on which a push rod 38 engages, the free end of which push rod can engage with recess 31. Spring 39 is fitted in order to achieve engagement in recess 31.

The installation described above functions as follows:

If waste has to be compacted, lid 11 is opened and this material is introduced through inlet opening 9. During this operation the partition pump is in the position shown in FIG. 1. Lid 11 is then closed and drum 6 in FIG. 1 is rotated clockwise, as a result of which the waste present in the upper left-hand part of the partition pump in FIG. 1 is subjected to a compacting movement. If the waste contains parts which are difficult to compact, so that too large a pressure is produced within the volume defined by the partition pump, part 12 of the wall of the chamber moves outwards against the force of spring 14. In normal cases, such a movement will not take place and the compacted material will be discharged at outlet 10 into container 2. At wall section 15, residual waste is removed by scrapers 16. It is necessary to rotate drum 5 stepwise by a quarter turn, after which new waste can be introduced. This signifies that compacted waste is never dumped directly into the container 2. If a motor drive is used, drum 6 of the partition pump is operated correspondingly, In the manually operated installation shown in FIG. 3 and FIG. 4, disc 30 will be rotated clockwise by moving the operating lever 36 in the direction of arrow 40 in FIG. 4. By the presence of only four recesses 31 and by limiting the stroke of the operating lever 36 in a manner which is not shown, it is ensured that a quarter turn is always carried out, the partitions 8 always being in the position shown in FIG. 1 when they come to rest. The construction according to FIGS. 3 and 4 comprises a ratchet mechanism.

In this way it is possible to compress the waste supported on all sides. This is in contrast to constructions according to the prior art, with which only local compression takes place.

Although the invention has been described above with reference to a preferred embodiment, it must be understood that numerous modifications can be made thereto without going beyond the scope of the present invention.

I claim:

1. Installation for compacting waste, comprising: a chamber having an inlet and an outlet; a rotary element housed in said chamber, said rotary element including a partition drum and a plurality of partitions; means for moving said rotary element in a direction along an interior wall of the chamber in order to define a space between the wall and the rotary chamber, said space decreasing in the direction of movement of the rotary element; and means for closing the inlet such that said means form a part of the wall of the chamber.

2. Installation according to claim 1, wherein the chamber has a wall section upstream of the outlet, and said upstream wall section is movable against a pretensioning force.

3. Installation according to claim 1, wherein the chamber has a wall section downstream of the outlet, and said downstream wall section is provided with scrapers.

4. Installation according to claim 1, wherein the chamber is cylindrical, and the center of rotation of the partitions is in the center of the cylindrical chamber.

5. Installation according to claim 1, further comprising sealing means fitted between the partition drum and the partitions.

6. Installation according to claim 1, wherein the partition drum is provided with means for driving said drum.

7. Installation according to claim 6, wherein the driving means are arranged to engage with a motor drive.

8. Installation according to claim 6, wherein the driving means comprise an element which is engageable only in a specific number of positions, said element adapted to be engaged by an operating lever.

9. Waste assembly comprising an installation for compacting in accordance with claim 1, positioned on a waste container.

* * * * *